United States Patent [19]

Ghandehari

[11] Patent Number: 5,015,306

[45] Date of Patent: May 14, 1991

[54] METHOD FOR PREPARING RARE EARTH-IRON-BORON SINTERED MAGNETS

[75] Inventor: Mohammad H. Ghandehari, Brea, Calif.

[73] Assignee: Union Oil Company of California, Los Angeles, Calif.

[21] Appl. No.: 428,857

[22] Filed: Oct. 30, 1989

Related U.S. Application Data

[62] Division of Ser. No. 48,321, May 11, 1987.

[51] Int. Cl.[5] ..... H01F 1/02

[52] U.S. Cl. ..... 148/103; 419/12; 419/38

[58] Field of Search ..... 148/101, 103, 104; 419/12, 38

[56] References Cited

U.S. PATENT DOCUMENTS

| | | | |
|---|---|---|---|
| 4,541,877 | 9/1985 | Stadelmaier et al. | 75/255 |
| 4,684,406 | 8/1987 | Matsuura et al. | 75/244 |

FOREIGN PATENT DOCUMENTS

| | | | |
|---|---|---|---|
| 52-50598 | 4/1977 | Japan . | |
| 55-132004 | 10/1980 | Japan | 148/104 |
| 61-81603 | 4/1986 | Japan | 419/12 |
| 61-81604 | 4/1986 | Japan | 419/12 |
| 61-81605 | 4/1986 | Japan | 419/12 |
| 61-81606 | 4/1986 | Japan | 419/12 |
| 61-81607 | 4/1986 | Japan | 419/12 |

OTHER PUBLICATIONS

A. L. Robinson, "Powerful New Magnet Material Found", *Science*, vol. 223, pp. 920–922 (1984).

M. Sagawa, S. Fujimura, N. Togawa, H. Yamamoto, and Y. Matsuura, "New Material for Permanent Magnets on a Base of Nd and Fe", *Journal of Applied Physics*, vol. 55, pp. 2083–2087 (1984).

M. Sagawa, S. Fujimura, H. Yamamoto, Y. Matsuura, and K. Hiraga, "Permanent Magnet Materials Based on the Rare Earth–Iron–Boron Tetragonal Compounds", *IEEE Transactions on Magnetics*, vol. Mag-20, pp. 1584–1589 (Sep. 1984).

S. Hirosawa, Y. Matsuura, H. Yamamoto, S. Fujimura, and M. Sagawa, "Magnetization and Magnetic Anisotropy of $R_2FE_{14}B$ Measured on Single Crystals", *Journal of Applied Physics*, vol. 59, pp. 873–879 (1986).

*Primary Examiner*—John P. Sheehan

*Attorney, Agent, or Firm*—Alan H. Thompson; Gregory F. Wirzbicki

[57] ABSTRACT

Permanent magnets are prepared by a method comprising mixing a particulate rare earth-iron-boron alloy with a particulate transition metal, aligning the magnetic domains of the mixture, compacting the aligned mixture to form a shape, and sintering the compacted shape.

29 Claims, No Drawings

METHOD FOR PREPARING RARE EARTH-IRON-BORON SINTERED MAGNETS

This application is a division of U.S. application Ser. No. 048,321, filed May 11, 1987.

INTRODUCTION TO THE INVENTION

The invention pertains to powder metallurgical compositions and methods for preparing rare earth-iron-boron sintered permanent magnets, and to magnets prepared by such methods.

Permanent magnets (those materials which exhibit permanent ferromagnetism) have, over the years, become very common, useful industrial materials. Applications for these magnets are numerous, ranging from audio loudspeakers to electric motors, generators, meters, and scientific apparatus of many types. Research in the field has typically been directed toward developing permanent magnet materials having ever-increasing strengths, particularly in recent times, when miniaturization has become desirable for computer equipment and many other devices.

The more recently developed, commercially successful permanent magnets are produced by powder metallurgy sintering techniques, from alloys of rare earth metals and ferromagnetic metals. The most popular alloy is one containing samarium and cobalt, and having an empirical formula $SmCo_5$ Such magnets also normally contain small amounts of other samarium-cobalt alloys, to assist in fabrication (particularly sintering) of the desired shapes.

Sanarium-cobalt magnets, however, are quite expensive, due to the relative scarcity of both alloying elements. This factor has limited the usefulness of the magnets in large volume applications such as electric motors, and has encouraged research to develop permanent magnet materials which utilize the more abundant rare earth metals, which generally have lower atomic numbers, and less expensive ferromagnetic metals. The research has led to very promising compositions which contain neodymium, iron, and boron in various proportions. Progress, and some predictions for future utilities, are given for compositions described as $R_2Fe_{14}B$ (where R is a light rare earth) by A. L. Robinson, "Powerful New Magnet Material Found," *Science*, Vol. 223, pages 920–922 (1984).

Certain of the compositions have been described by M. Sagawa, S. Fujimura, N. Togawa, H. Yamamoto, and Y. Matsuura "New Material for Permanent Magnets on a Base of Nd and Fe," *Journal of Applied Physics*, Vol. 55, pages 2083–2087 (1984). In this paper, crystallographic and magnetic properties are reported for various $Nd_xB_yFe_{100-x-y}$ compositions, and a procedure for preparing permanent magnets from powdered $Nd_{15}B_8Fe_{77}$ is described. The paper discusses the impairment of magnetic properties which is observed at elevated temperatures and suggests that the partial substitution of cobalt for iron in the alloys can be beneficial in avoiding this impairment.

Additional information about the compositions is provided by M. Sagawa, S. Fujimura, H. Yamamoto, Y. Matsuura, and K. Hiraga, "Permanent Magnet Materials Based on the Rare Earth-Iron-Boron Tetragonal Compounds," *IEEE Transactions on Magnetics*, Vol. MAG-20, Sept. 1984, pages 1584–1589. Substituting small amounts of terbium or dysprosium for neodymium in the alloy is said to increase the coercivity of neodymium-iron-boron magnets; a comparison is made between $Nd_{15}Fe_{77}B_8$ and $Nd_{13.5}Dy_{1.5}Fe_{77}B_8$ magnets.

The present inventor has disclosed additives for increasing the coercivity of rare earth-iron-boron sintered permanent magnets, in previously filed patent applications. U.S. patent application Ser. No. 745,295 filed on June 14, 1985 describes the addition of particulate rare earth oxides, before alignment, compaction, and sintering. U.S. patent application Ser. No. 869,045 filed on May 30, 1986 is directed to similarly added particulate aluminum.

SUMMARY OF THE INVENTION

One aspect of the invention is a method for producing rare earth-iron-boron permanent magnets, comprising the steps of: (1) mixing a particulate alloy containing at least one rare earth metal, iron, and boron, with at least one particulate transition metal; (2) aligning magnetic domains of the mixture in a magnetic field; (3) compacting the aligned mixture to form a shape; and (4) sintering the compacted shape. Most preferably, the transition metal is one or more of the heavy lanthanides. The alloy can be a mixture of rare earth-iron-boron alloys and, in addition, a portion of the iron can be replaced by another ferromagnetic metal, such as cobalt. This invention also encompasses compositions for use in the method, and products produced thereby.

DETAILED DESCRIPTION OF THE INVENTION

As used herein, the term "rare earth" includes the lanthanide elements having atomic numbers from 57 through 71, plus the element yttrium, atomic number 39, which is commonly found in certain lanthanide-containing ores and is chemically similar to the lanthanides.

The term "heavy lanthanide" is used herein to refer to those lanthanide elements having atomic numbers 63 through 71, excluding the "light rare earths" with atomic numbers 62 and below.

"Transition metals" are elements having atomic numbers 21 through 30, 39 through 48, 57 through 80, and those with atomic numbers at least 89.

"Ferromagnetic metals" include iron, nickel, cobalt, and various alloys containing one or more of these metals. Ferromagnetic metals and permanent magnets exhibit the characteristic of magnetic hysteresis, wherein plots of induction versus applied magnetic field strengths (from zero to a high positive value, and then to a high negative value and returning to zero) are hysteresis loops.

Points on the hysteresis loop which are of particular interest for the present invention lie within the second quadrant, or "demagnetization curve," since most devices which utilize permanent magnets operate under the influence of a demagnetizing field. On a loop which is symmetrical about the origin, the value of field strength (H) for which induction (B) equals zero is called coercive force ($H_c$) This is a measure of the quality of the magnetic material. The value of induction where applied field strength equals zero is called residual induction ($B_r$). Values of H will be expressed in Oersteds ($O_e$), while values of B will be in Gauss (G). A figure of merit for a particular magnet shape is the energy product, obtained by multiplying values of B and H for a given point on the demagnetization curve and expressed in Gauss-Oersteds (GOe). When these unit abbreviations are used, the prefix "K" indicates multiplication by $10^3$, while "M" indicates multiplication by $10^6$. When the energy products are plotted against B, one point ($BH_{max}$) is found at the maximum point of the curve; this point is also useful as a criterion for comparing magnets. Intrinsic coercivity ($iH_c$) is found where (B-H) equals zero in a plot of (B-H) versus H.

The present invention is a method for preparing permanent magnets based upon rare earth-iron-boron alloys, which invention also includes certain compositions useful in the method and the magnets prepared thereby. This method comprises mixing a particulate rare earth-iron-boron alloy with a particulate transition metal, before the magnetic domain alignment, shape-forming, and sintering steps are undertaken.

Suitable rare earth-iron-boron alloys for use in this invention include those discussed in the previously noted paper by Robinson, those by Sagawa et al., as well as others in the art. Magnets currently being developed for commercialization generally are based upon neodymium-iron-boron alloys, but the present invention is also applicable to alloy compositions wherein one or more other rare earths, particularly those considered to be light rare earths, replaces all or some fraction of the neodymium. In addition, a portion of the iron can be replaced by one or more other ferromagnetic metals, such as cobalt.

The alloys can be prepared by several methods, with the most simple and direct method comprising melting together the component elements, e.g., neodymium, iron, and boron, in the correct proportions. Prepared alloys are usually subjected to sequential particle size reduction operations, preferably sufficient to produce particles of less than about 200 mesh (0.075 millimeter diameter).

To the magnet alloy powder is added transition metal, preferably having particle sizes and distributions similar to those of the alloy. The metal additive can be mixed with alloy after the alloy has undergone particle size reduction, or can be added during size reduction, e.g., while the alloy is present in a ball mill. The alloy and metal additive are thoroughly mixed and this mixture is used to prepare magnets by the alignment, compaction, and sintering steps.

The transition metal additive can be a single element or a mixture of elements. Rare earth metals are preferred additives. Particularly preferred at present are the heavy lanthanides, especially dysprosium and terbium (appearing to function similarly to dysprosium and terbium metal substitutions, which were reported by Sagawa et al. in the *IEEE Transactions on Magnetics*, discussed supra). Niobium and molybdenum are also quite effective additives and, therefore, are highly preferred in the invention. Suitable amounts of transition metal normally are about 0.5 to about 10 weight percent of the magnet alloy powder; more preferably about 0.5 to about 5 weight percent additive is used.

It should be noted that the transition metal additive can itself be an alloy, preferably one in which a transition metal element comprises at least about 50 percent by weight. This can be of particular advantage when transition metals having very high melting points are to be used; alloying with, for example, aluminum will yield a low-melting point additive which is liquid at magnet sintering temperatures. Representative alloy additives which are useful in the invention include: alloys of aluminum with one or more of dysprosium, niobium, and molybdenum; alloys of dysprosium with niobium and/or molybdenum; and many others.

The powder mixture is placed in a magnetic field to align the crystal axes and magnetic domains, preferably simultaneously with a compacting step, in which a shape is formed from the powder. This shape is then sintered to form a magnet having good mechanical integrity, under conditions of vacuum or an inert atmosphere (such as argon). Typically, sintering temperatures about 1060° C. to about 1100° C. are used.

By use of the invention, permanent magnets are obtained which have increased coercivity, over magnets prepared without added transition metal powders. This is normally accompanied by a decrease in magnet residual induction, but nonetheless makes the magnet more useful for many applications, including electric motors.

While it is not desired to be bound to any particular theory of operation, it is currently believed that an alloy having the empirical formula $Nd_{15}Fe_{77}B_8$ has three phases: a high-melting point, main magnetic phase which is approximately $Nd_2Fe_{14}B$; a more neodymium-rich, low-melting point phase which is responsible for sintering properties of the alloyl; and a high-melting point, boron-rich phase. Many of the rare earth additives, which are exemplified for this discussion by dysprosium, are likely to dissolve in the liquid neodymium-rich phase during sintering, then diffuse into particles of the main magnetic phase. Dysprosium is able to partially substitute for neodymium in the $Nd_2Fe_{14}B$ crystals, giving the crystals a higher magnetic anisotropy; due to the nature of the diffusion process and the relative shortness of the sintering times, dysprosium tends to remain near the grain boundaries. Since demagnetization of a particle begins with magnetic domains at the grain boundary, the dysprosium-substituted areas, with their higher anisotropy, become more resistant to domain reversal. Electron micrographic studies show that the dysprosium indeed remains near grain boundaries when added in the manner of the present invention, but is fairly evenly distributed throughout particles when it is a component of the gross alloy (as in the Sagawa et al. $Nd_{13.5}Dy_{1.5}Fe_{77}B_8$ magnets).

Many transition metals, however, do not have magnetic properties and cannot be substituted into crystals of the main magnetic phase. These additives, as exemplified by niobium and molybdenum, appear to dissolve in the liquid neodymium-rich phase, but locate near grain boundaries of the main magnetic phase where they precipitate upon cooling from sintering temperatures. Particles of non-magnetic metal at the grain boundaries slow the propagation of domain reversal, under an applied demagnetizing force, or act as domain pinning sites. Inhibiting domain reversal at the grain boundaries increases the intrinsic coercivity of a magnet.

In the case of the rare earth additives, it should be remembered that not all can substitute for neodymium to produce higher magnetic anisotropy. According to S. Hirosawa, Y. Matsuura, H. Yamamoto, S. Fujimura, and M. Sagawa, "Magnetization and Magnetic Anisotropy of $R_2Fe_{14}B$ Measured on Single Crystals," *Journal of Applied Physics*, Vol. 59, pages 873–879 (1986), yttrium, cerium, samarium, gadolinium, erbium, and thulium form compounds having lower single crystal magnetic anisotropy values than is obtained with neodymium. Substituting these elements would decrease coercivity of a magnet. Surprisingly, it has been discovered that neodymium additions can increase coercivity, which effect is possibly due to its ability to increase the concentration of the low-melting phase and thereby facilitate better separation of the main magnetic phase grains in a sintered magnet; the effect of neodymium additions may be diminished for gross alloys which are made to contain an excess of neodymium.

The invention will be further described by the following example, which is not intended to be limiting, the invention being defined solely by the appended claims. In the example, all percentage compositions are expressed on a weight basis.

EXAMPLE

An alloy having the nominal composition 33.5% Nd-65.2% Fe-1.3% B is prepared by melting together elemental neodymium, iron, and boron in an induction furnace, under an argon atmosphere. After the alloy is allowed to solidify, it is heated at about 1070° C. for about 96 hours, to permit remaining free iron to diffuse into other alloy phases which are present. The alloy is cooled, crushed by hand tools to particle sizes less than about 70 mesh (0.2 millimeters diameter), and milled in an attritor under an argon atmosphere, in trichlorotrifluoroethane, to obtain a majority of particle diameters about 5 to 10 micrometers in diameter. After drying under a vacuum, the alloy is ready for use to prepare magnets.

Samples of the alloy powder are used to prepare magnets, using the following procedure:

(1) additive powders are weighed and added to weighed amounts of alloy powder;

(2) the mixture is vigorously shaken in a glass vial by hand for a few minutes, to intimately mix the components;

(3) magnetic domains and crystal axes are aligned by a transverse field of about 14.5 KOe while the powder mixture is being compacted loosely in a die, then the pressure on the die is increased to about 10,000 p.s.i.g. for 20 seconds;

(4) the compacted "green" magnets are sintered under argon at about 1070° C. for one hour and then rapidly moved into a cool portion of the furnace and allowed to cool to room temperature.

(5) cooled magnets are annealed at about 900° C. under argon for about 2 or 3 hours and then rapidly cooled in the furnace, as described above, followed by one hour of annealing at about 610° C. and another rapid cooling.

Properties of the prepared magnets are summarized in Table I, wherein metals enclosed by brackets are added in the form of a mixture. These data indicate that a transition metal additive generally improves the coercivity of a neodymium-iron-boron magnet. Cobalt is seen to slightly decrease coercivity, but can be a most useful additive, since it raises the Curie temperature of the magnet, permitting magnet use in higher-temperature environments. Also, adding cobalt simultaneously with a coercivity-improving metal can give improvement in both coercivity and Curie temperature. As compared to the dysprosium oxide additive, greater coercivity enhancement is obtained when dysprosium metal is used. Further, less of the transition metals normally is needed when a small amount of aluminum is also added.

Various embodiments and modifications of this invention have been described in the foregoing description and example, and further modifications will be apparent to those skilled in the art. Such modifications are included within the scope of the invention as defined by the following claims.

TABLE I

| Additive | | $B_r$ | $H_c$ | $iH_c$ | $BH_{max}$ |
|---|---|---|---|---|---|
| Formula | Wt. Percent | (Gauss × $10^3$) | (Oersted × $10^3$) | (Oersted × $10^3$) | (MGOe) |
| — | — | 12,000 | 9,900 | 12,500 | 36 |
| Dy | 3.5 | 10,900 | 10,500 | 20,600 | 29 |
| $Dy_2O_3$ | 4 | 11,500 | 10,900 | 17,000 | 30 |
| — | — | 12,000 | 9,000 | 11,700 | 36 |
| Dy | 3.5 | 10,750 | 10,300 | 18,500 | 28 |
| [ Al | 0.5 | 11,200 | 10,800 | 18,400 | 30.5 |
| Dy ] | 1 | | | | |
| Mo | 0.5 | 11,750 | 8,800 | 14,500 | 34.4 |
| [ Al | 0.5 | 11,600 | 11,200 | 16,600 | 33.0 |
| Mo ] | 0.5 | | | | |
| [ Al | 0.5 | 11,250 | 10,900 | 14,500 | 31.0 |
| Mo ] | 0.5 | | | | |
| Nb | 1 | 12,000 | 10,800 | 14,500 | 36.0 |
| [ Al | 0.5 | 11,700 | 11,200 | 16,000 | 33.5 |
| Nb ] | 1 | | | | |
| [ Al | 0.5 | 11,400 | 10,900 | 13,700 | 33.0 |
| Nb ] | 0.5 | | | | |
| Al | 0.5 | 11,300 | 11,000 | 13,900 | 32.0 |
| Co | 0.5 | 12,000 | 9,100 | 10,900 | 34.6 |
| Co | 1 | 12,000 | 8,500 | — | 33.5 |
| [ Al | 0.5 | 11,300 | 10,800 | 13,500 | 31.5 |
| Co ] | 0.5 | | | | |
| — | — | 12,000 | 9,700 | 12,200 | 36 |
| Nd | 3.5 | 11,350 | 10,500 | 13,200 | 29 |

I claim:

1. A method for producing permanent magnets, comprising the steps of:

(a) mixing a particulate alloy containing at least one light rare earth metal, iron, boron, a ferromagnetic metal selected from the group consisting of nickel, cobalt, and mixtures thereof, with at least one particulate metal additive containing a heavy lanthanide metal, said particulate alloy comprising a main magnetic phase having an empirical formula of about $ND_2(Fe+Co)_{14}B$;

(b) aligning magnetic domains of the mixture in a magnetic field;

(c) compacting the aligned mixture to form a shape; and (d) sintering the compacted shape for sufficient time to produce said permanent magnets having said heavy lanthanide metal near the grain boundaries of particles of said main magnetic phase.

2. The method defined in claim 1, wherein the alloy comprises neodymium.

3. The method defined in claim 1, wherein the additive comprises dysprosium metal.

4. The method defined in claim 3, wherein the heavy lanthanide is selected from the group consisting of gadolinium, terbium, dysprosium, holmium, and mixtures thereof.

5. The method defined in claim 4, wherein the heavy lanthanide is selected from the group consisting of terbium, dysprosium, and mixtures thereof.

6. The method defined in claim 1, wherein the heavy lanthanide metal is present in an alloy.

7. The method defined in claim 1, wherein the heavy lanthanide metal is in an alloy with aluminum.

8. The method defined in claim 1, wherein the additive further comprises particulate aluminum.

9. The method defined in claim 1, further comprising the step of:

(e) annealing the sintered shape.

10. A method for producing permanent magnets, comprising the steps of:

(a) mixing a particulate alloy containing neodymium, iron, and boron with at least one particulate heavy lanthanide;

(b) aligning magnetic domains of the mixture in a magnetic field;

(c) compacting the aligned mixture to form a shape; and (d) sintering the compacted shape.

11. The method defined in claim 10, wherein the alloy further contains a ferromagnetic metal selected from the group consisting of nickel, cobalt, and mixtures thereof.

12. The method defined in claim 10, wherein the heavy lanthanide is selected from the group consisting of gadolinium, terbium, dysprosium, holmium, and mixtures thereof.

13. The method defined in claim 10, wherein the heavy lanthanide is selected from the group consisting of terbium, dysprosium, and mixtures thereof.

14. The method defined in claim 10, wherein the heavy lanthanide is in an alloy with one or more of aluminum, niobium, or molybdenum.

15. The method defined in claim 10, wherein there is added with the heavy lanthanide one or more of particulate aluminum, niobium, or molybdenum.

16. The method defined in claim 10, further comprising the step of:

(e) annealing the sintered shape.

17. A method for producing permanent magnets, comprising the steps of:

(a) mixing together components:

(i) a particulate alloy consisting essentially of neodymium, iron, and boron; and (ii) a particulate heavy rare earth metal selected from the group consisting of gadolinium, terbium, dysprosium, holmium, and mixtures thereof;

(b) aligning magnetic domains of the mixture in a magnetic field;

(c) compacting the aligned mixture to form a shape;

(d) sintering the compacted shape; and (e) annealing the sintered shape.

18. The method defined in claim 17, wherein the heavy rare earth metal is terbium.

19. The method defined in claim 17, wherein the heavy rare earth metal is dysprosium.

20. The method defined in claim 17, wherein the heavy rare earth metal is in an alloy with one or more of aluminum, niobium, or molybdenum.

21. The method defined in claim 17, wherein the heavy rare earth metal is added with one or more of a particulate aluminum, niobium, or molybdenum.

22. A method for producing permanent magnets, comprising the steps of:

(a) mixing together components:

(i) a particulate alloy consisting essentially of neodymium, iron, cobalt, and boron; and (ii) a particulate heavy rare earth metal selected from the group consisting of gadolinium, terbium, dysprosium, holmium, and mixtures thereof;

(b) aligning magnetic domains of the mixture in a magnetic field;

(c) compacting the aligned mixture to form a shape;

(d) sintering the compacted shape; and (e) annealing the sintered shape.

23. The method defined in claim 22, wherein the heavy rare earth metal is terbium.

24. The method defined in claim 22, wherein the heavy rare earth metal is dysprosium.

25. The method defined in claim 22, wherein the heavy rare earth metal is in an alloy with one or more of aluminum, niobium, or molybdenum.

26. The method defined in claim 22, wherein the heavy rare earth metal is added with one or more of particulate aluminum, niobium, or molybdenum.

27. The method defined in claim 10 wherein said particulate alloy in step (a) comprises a main magnetic phase having an empirical formula of about $Nd_2Fe_{14}B$ and said compacted shape in step (d) is sintered for sufficient time to produce said permanent magnets having said heavy lanthanide metal near the grain boundaries of particles of said main magnetic phase.

28. The method defined in claim 17 wherein said particulate alloy in step (a) (i) comprises a main magnetic phase having an empirical formula of about $Nd_2Fe_{14}B$ and said compacted shape in step (d) is sintered for sufficient time to produce said permanent magnets having said heavy rare earth metal near the grain boundaries of particles of said main magnetic phase.

29. The method defined in claim 22 wherein said particulate alloy in step (a) (i) comprises a main magnetic phase having an empirical formula of about $Nd_2(Fe+Co)_{14}B$ and said compacted shape in step (d) is sintered for sufficient time to produce said permanent magnets having said heavy rare earth metal near the grain boundaries of particles of said main magnetic phase.

* * * * *